US009199126B1

(12) United States Patent
Martin

(10) Patent No.: US 9,199,126 B1
(45) Date of Patent: Dec. 1, 2015

(54) SWIM FIN WITH SHARK-LIKE MOVEMENT

(71) Applicant: Herbert Martin, Paducah, KY (US)

(72) Inventor: Herbert Martin, Paducah, KY (US)

( * ) Notice: Subject to any disclaimer, the term of this patent is extended or adjusted under 35 U.S.C. 154(b) by 0 days.

(21) Appl. No.: 14/580,346

(22) Filed: Dec. 23, 2014

(51) Int. Cl.
*A63B 31/14* (2006.01)
*A63B 31/11* (2006.01)
*A63B 31/08* (2006.01)
*A63B 35/02* (2006.01)

(52) U.S. Cl.
CPC ..... *A63B 31/08* (2013.01); *A63B 31/11* (2013.01); *A63B 31/14* (2013.01); *A63B 35/02* (2013.01)

(58) Field of Classification Search
CPC ..... A63B 31/14; A63B 31/11
USPC ..... 441/61, 64, 55; 440/15
See application file for complete search history.

(56) References Cited

U.S. PATENT DOCUMENTS 1,530,560 A * 3/1925 Heminger ..... A63B 35/02 441/55
3,426,722 A * 2/1969 Dragich ..... A63B 35/02 441/55
3,440,994 A * 4/1969 McGowan ..... A63B 35/02 440/15
3,529,565 A * 9/1970 Iglesias ..... A63B 35/02 441/55
4,193,371 A * 3/1980 Baulard-Caugan .... A63B 35/02 440/15
4,869,696 A * 9/1989 Ciccotelli ..... A63B 31/11 441/55
6,524,145 B1 * 2/2003 Arzate ..... A63B 35/02 114/315
6,558,210 B2 * 5/2003 Frasier ..... B63C 11/46 440/14
6,561,862 B1 * 5/2003 Moore ..... A63B 35/02 440/14

* cited by examiner

*Primary Examiner* — Lars A Olson
*Assistant Examiner* — Jovon Hayes
(74) *Attorney, Agent, or Firm* — Stockwell & Smedley, PSC

(57) ABSTRACT

Embodiments of the present invention include a swim fin, including a swivel motion thruster, a tailfin coupled with the swivel motion thruster, a spine rod hingeably coupled via a first hinged coupling with the swivel motion thruster at a first end of the spine rod, a first foot pocket coupled with the swivel motion thruster on one side of the first hinged coupling and a second foot pocket coupled with the swivel motion thruster on an opposite side of the first hinged coupling such that movement of the first foot pocket toward the tailfin results in an arcuate motion of the tailfin about the first hinged coupling away from the first foot pocket, and a belt coupled with a second end of the spine rod opposite the first end, wherein the belt is configured to frictionally fit to a human body.

19 Claims, 13 Drawing Sheets

SWIM FIN WITH SHARK-LIKE MOVEMENT

BACKGROUND

The present invention relates to swimming accessories and, more particularly to a self-propelled swimming accessory.

Many swimming aids have the appearance of fins. Some of these flippers focus on improved forward propulsion through the water and others are designed around a secondary purpose of walking on land or climbing a ladder to circumvent the need for removal of the fins. To date, the majority of flippers on the market are designed to extend from the swimmer in a direction in agreement with the swimmer's feet, thereby creating the effect of a longer foot with webbed toes for the swimmer. Even though these devices look like frog's feet, the swimmer is restricted from using the frog kick when using them. The flutter kick may then be the most efficient kick using these fins. The dolphin kick is also excellent for forward propulsion with flippers, but the dolphin kick is too tiring for any form of distance swimming for the average swimmer.

SUMMARY

An embodiments of the present invention includes a swim fin having a swivel motion thruster, a tailfin coupled with the swivel motion thruster, a spine rod hingeably coupled via a first hinged coupling with the swivel motion thruster at a first end of the spine rod, a first foot pocket coupled with the swivel motion thruster on one side of the first hinged coupling and a second foot pocket coupled with the swivel motion thruster on an opposite side of the first hinged coupling such that movement of the first foot pocket toward the tailfin results in an arcuate motion of the tailfin about the first hinged coupling away from the first foot pocket, wherein each of the first foot pocket and the second foot pocket is configured to receive a respective human foot, and a belt coupled with a second end of the spine rod opposite the first end, wherein the belt is configured to frictionally fit to a human body.

Another embodiment of the present invention includes a swimming aid having a belt configured to frictionally fit a human body, a spine rod having a first end and a second end, wherein the first end is coupled with the belt and the spine rod extends away from the belt to the second end, a swivel hinge having a first portion connected to the second end of the spine rod, a straight rod having third end and a fourth end, wherein the swivel hinge has a second portion connected to the straight rod at a position substantially equidistant from the third end and fourth end, a first pedal hinge connected at the third end, a second pedal hinge connected at the fourth end, a first foot pocket connected to the first pedal hinge, a second foot pocket connected to the second pedal hinge, an arcuate rod, having a fifth end and a sixth end, wherein the fifth end is connected to the third end of the straight rod and the sixth end is connected to the fourth end of the straight rod, a tailfin connected at an apex of the arcuate rod wherein a plane of the tailfin is substantially perpendicular to a plane of the arcuate rod, wherein the tailfin includes a first edge and a second, opposite, edge in the plane of the tailfin and a distance between the first edge and the second edge increases as the tailfin extends away from the arcuate rod.

DETAILED DESCRIPTION

Figure 1:
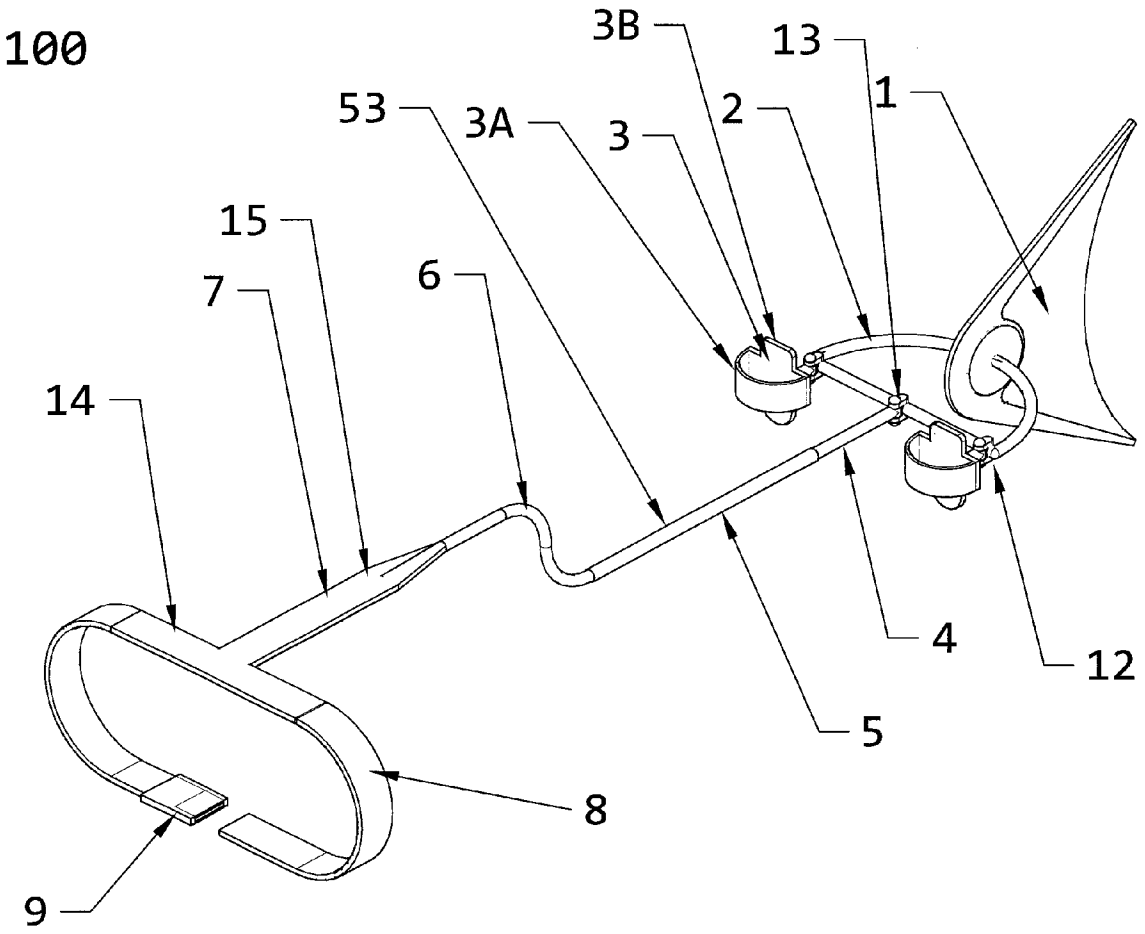
FIG. 1 illustrates an embodiment of the present invention wherein a swim fin is back mounted and front buckled.

Many swimmers became aware of flippers at an early age, having viewed films of scuba diving and underwater research. These swimmers recognized the common flippers as having a closed toe pocket with a heel strap and a long flipper portion which turns the swimmer's feet into something resembling frog feet like those of "the creature from the black lagoon." While these flippers undoubtedly improve the speed with which a diver can maneuver through the depths, they are still limited in their effectiveness by the sweep of the stroke and the strength of the swimmer's legs. Due to these limitations, a diver may not be able to match the speed of a fish.

It is believed that a method of moving through the water that approximates the movement of a fish may be more effective than use of conventional flippers. It is also believed that walking on land with flippers may be ineffective, inconvenient, and unimportant. Therefore, a swimming aid that is easily removable may be more convenient than conventional flippers. Thus, the swimmer could move effectively in the water with the swimming aid and could also move effectively on land after easy removal of the swimming aid. Embodiments of the present invention are intended to provide for the swimmer a method for more closely approximating the natural motion of a fish through the water and for providing forward thrust beyond natural human capability. The attach-able swim fin device is easily affixed to or removed from the human body and provides fish-like movements.

Human bodies naturally bend forward from the waist and hips and backward at the knees. Embodiments of the present invention interface with the human form to obtain fish-like propulsion in water. Embodiments of the present invention include devices made to improve swimming effectiveness and to work in harmony with the natural movements of the human body. Fish body movements allow the fish's tail to move in a lateral sweeping arc, propelling water behind the fish and propelling the fish through the water. Embodiments of the present invention allow the human body to engage in a movement similar to that of a fish. Thus, embodiments of the present invention is to allow the swimmer to swim faster and farther with less effort. In turn, less oxygen would need to be consumed during deep sea scuba diving. Additionally, embodiments of the present invention enable a user to quickly remove the device for land travel mode after exploring the depths of the sea. No other products on the market at the time of this disclosure have a similar design.

Embodiments of the present invention provide for converting a jogging-in-place movement or alternating toe lift by bending at the ankles, into a method of traversing through water in a movement similar to that of a fish. A swim fin 100 of the present invention may comprise many parts: an optional, detachable shoulder strap to help retain the positioning of the swim fin 100 when pressure is applied to toe pockets; a belt that attaches to a swimmer's waist; a transition piece that may couple the belt to an adjustable spine rod; a swivel connector at the end of the adjustable spine rod that may couple to the midpoint of a transverse rod; two swivel connectors at both respective ends of the transverse rod, each one of which connects to one of the toe pockets, wherein each toe pocket is at opposite ends of the transverse rod; a semicircular rod or triangular shaped rod that may be attached to the two ends of the transverse rod and situated on the opposite side of the transverse rod relative to the toe pockets; two cylindrical compression pads splitting the semicircular rod at an apex quadrant; and a flexible fin that may be similar in shape to an isosceles triangle or an equilateral triangle positioned vertically between the two cylindrical compression pads with the apex nearest to and at the base farthest from the body of the swimmer. The fin can be composed of thin, flexible rubber-like material, while the upper and lower edges that form the vertex may be a thicker, flexible material for greater strength to the fin and for the purpose of providing a more powerful stroke as the fin sweeps back and forth during use.

In one embodiment of the invention, the belt may comprise a rigid piece that runs transverse to the swimmer's spine and may be rigidly attached to a rigid transition piece, forming a T-shape against the swimmer's back. Attached to this transverse rigid piece may be adjustable, flexible straps on each end and these may gird the swimmer's midsection. Furthermore, a snap-together buckle complementing each end of the strap may be present to allow the swimmer to quickly don and remove the entire apparatus while still in the water. This buckle could be similar in nature to the buckle on a Boy Scout belt. In another embodiment of the invention, the spine rod may be positioned on the swimmer's back and a single-strap belt may fasten in front of the swimmer's stomach.

In another embodiment of the invention, the belt may be positioned in place before the swimmer enters the water and the T-shaped plate may not necessarily be permanently attached to the belt. Rather, it may be inserted into the belt after the swimmer is in the water. This T-shaped plate has two rigid male slats on either end that are in a fixed position to be inserted into two corresponding female slots that are on a rigid transverse piece that may be connected to the belt. These two components can maintain a precise placement so that the swim fin can be easily removed and reinserted while the swimmer is in the water. The female slots may be permanently attached to a transverse rod that may receive two adjustable waist or hip braces that may be designed to prevent swivel movement of the entire apparatus at the waist position. The adjustable aspect of the assembly may be designed to accommodate various waist sizes. This entire assembly, exclusive of the T-shaped plate, may be attached to the swimmer's waist by a belt and buckle similar in nature to that in the previous embodiment of the invention. In this second embodiment, the spine rod of the device may be positioned on the swimmer's stomach for ease of removal and reattachment while the swimmer is in the water. In both cases, the swim fin 100 apparatus can be removed and carried by hand when the swimmer arrives a point of shallow water where walking is possible.

The T-shaped plate, which may beneficially be flat in some embodiments, may be connected by a transition piece that may be attached to the adjustable spine rod of the apparatus. It may be adjustable to accommodate the varying distances from hip to ankle of the various swimmers. Furthermore, the spine rod may be either rigid or rigidly flexible. The adjustable spine rod transitions to the swivel motion connector which contains two toe pocket pressure pads at either end of the transverse rod and the fin at the apex or quadrant.

The size and design of the entire tailfin 1 section may be contingent on how much of a wake the swimmer chooses to create and upon which motion of propulsion the swimmer chooses to use. If the swimmer chooses to exert a motion of propulsion similar to the jogging-in-place movement, the sweep of the tail assembly may be larger than if an alternating toe-lift movement is employed. The tailfin may be comprised of a flexible lightweight material, may be reinforced by thickening the material along edges of the fin, and may include pressure pads at the point where the energy is transferred from the swimmer through the swivel-motion connector to the tailfin. The swim fin may also be used by a less buoyant swimmer attempting to tread water.

FIG. 1 illustrates an embodiment of the present invention wherein a swim fin is back mounted and front buckled. A tailfin may allow forward propulsion through the water of a human attached to the swim fin. The tailfin may move in an arcuate sweeping fashion, wherein the material of the tailfin 1 may flex. The flexing of the material of the tailfin 1 may provide force against the water that is parallel with a longitudinal axis of the attached human. Constructing the tailfin 1 from a rigid material may also be sufficient to provide some forward thrust. The tailfin 1 may comprise any material sufficient for forward propulsion of the attached human through water. Furthermore, the material of the tailfin 1 may be water or salt water resistant. Example flexible or rigidly flexible materials may comprise polyurethane, other plastics, rubber, or other flexible materials. Example rigid materials may include wood, plastics such as polyvinylchloride, or other rigid materials. The size of the tailfin 1 may be selected based on the desired behavior of the swim fin 100 underwater. For example, a larger tailfin may provide for a slower rhythm of the arcuate sweeping motion and may further provide greater speed over a longer distance than a smaller fin. However, a larger tailfin may not be suitable for quick starts and maneuvering around coral reefs, because starting from standstill may require greater strength than starting using a smaller fin. The smaller fin may have a shorter arcuate sweep and a quicker rhythm with less resistance to begin from a dead stop.

The smaller fin size may be suitable for maneuverability wherein acceleration, rather than top speed, may be important.

A swivel motion thruster 2 of FIG. 1 is connected with the tailfin 1 in any manner suitable for converting leg motion of the attached human into the arcuate sweep of the tailfin 1 that approximates the motion of a fish's tailfin. The swivel motion thruster 2 may be integrally formed with the tailfin 1. In the embodiment of FIG. 1, the swivel motion thruster 2 is shown as a straight rod and an arcuate rod adjoining the ends of the straight rod. However, other embodiments of the swivel motion thruster 2 may comprise a triangular rod in place of the arcuate rod. The tailfin 1 may be connected on the arcuate rod. In some embodiments, the tailfin 1 may be connected at the apex of the arcuate rod (i.e. the point on the arcuate rod at greatest distance from the straight rod). This rod may be comprised of any material capable of withstanding the stress of propelling the attached human through water and transferring thrust from the tailfin 1 to the attached human. Some example materials include wood, metals, coated metals, plastics, rubber, fiberglass, carbon fiber, bone, bamboo, foams, high density foams, and similar materials. However, lightweight materials may be desired for safety and efficiency reasons. Lightweight metals such as aluminum may be suitable, polyvinyl chloride may be one of the suitable plastics, and most rubber materials are lightweight enough to be suitable. Each of these materials may be resistant to rust and corrosion in light of the repeated exposure to water or salt water.

Foot pockets 3 may be connected with the swivel motion thruster 2 in any manner sufficient to translate leg or foot motion of the attached human into forward thrust. For example, the foot pockets 3 may secure the toe or foot of the attached human. Furthermore, straps 3*a* may be adjustable to accommodate humans of differing sizes or even different placements on the human foot. The strap 3*a* may comprise any material sufficient to withstand pulling against the strap 3*a* when performing the leg motion necessary for movement. Some examples include woven thread, twine, rubber, plastic, wood, metal, foam, and similar materials. A pedal 3*b* of the foot pocket 3 may comprise any material sufficient to withstand pushing on the pedal 3*b* when performing the leg motion necessary for movement. Some example materials include wood, metals, coated metals, plastics, rubber, fiberglass, carbon fiber, bone, bamboo, foams, high density foams, and similar materials. The connection between the strap 3*a* and the pedal 3*b* may be sufficient to withstand the stress of the leg motion necessary for movement of the swim fin 100. The strap 3*a* could continue through a plane of the pedal 3*b* and connect to a stopper. The stopper may prevent the strap 3*a* from leaving the pedal 3*b* and may withstand pulling stress. Alternatively, the strap 3*a* and the pedal 3*b* may be integrally formed. Each pedal 3*b* may be hingeably connected with the swivel motion thruster 2 by a respective pedal hinge 12. This mechanism may allow rotation of each of the foot pockets 3 such that the attached human may perform a jogging-in-place motion to propel the swim fin 100 without having to twist at the knees or hips.

In the embodiment shown in FIG. 1, a spine rod 53 may be hingeably connected with the straight rod of the swivel motion thruster 2. In the embodiment of FIG. 1, the spine rod 53 comprises a flexible spine rod 4. The spine rod 53 may be solid and can also comprise an adjustable spine rod 5 and a transition rod 6. The spine rod 53 may also have a first end and a second end. A hinge mechanism connecting the flexible spine rod 4 and the swivel motion thruster 2 may comprise a swivel hinge 13. The swivel hinge 13 may be connected at an end of the flexible spine rod 4 and at the center of the straight rod of the swivel motion thruster 2. However, any placement of the swivel hinge 13 or even multiple swivel hinges 13 could be used so long as bodily movement of the attached human would be converted into forward thrust underwater.

The flexible spine rod 4 may comprise a flexible material such that the range of the arcuate swivel of the swim fin 100 may be extended. The flexible material of the flexible spine rod 4 may cause stiff resistance thereby providing for a quick acceleration as the flexible spine rod 4 flicks back into the original unbent position. Therefore, the flexible spine rod 4 may have a flexed position and a straight position. The structure of the flexible spine rod 4 could be a solid or hollow rod or could even be a spring. The rigid flick of the flexible spine rod 4 may more closely approximate the quick takeoff of a fish. However, the material may also be rigid enough to transfer forward thrust from the tailfin 1 to the attached human. Capable materials may be flexible or rigidly flexible. Example materials may include metals, plastics, rubber, fiberglass, carbon fiber, polyurethane, foams, high density foams, bone, sinew, bamboo, and similar materials. In some embodiments, the spine rod 53 may comprise any combination of a flexible spine rod 4, a rigid spine rod 35, an adjustable spine rod 5, and a transition rod 6.

The flexible spine rod 4 may be connected with an adjustable spine rod 5 at the end opposite the swivel hinge 13. The flexible spine rod 4 may fit within the adjustable spine rod 5. Furthermore, the flexible spine rod may be extendable from the adjustable spine rod and locked in place using a ratchet-latch assembly, a twist-lock assembly or similar mechanism. The flexible spine rod 4 may be elongated or retracted lengthwise relative to the adjustable spine rod 5 to adjust for the height of the attached human. Furthermore, the length of the adjustable spine rod 5 may be fixed by use of any fixing mechanism sufficient to cause the position of the flexible spine rod 4 relative to the adjustable spine rod 5 to remain static. One such fixing mechanism may be a pin system, such as a push pin, a hitch pin, or a linch pin. In these systems, the flexible spine rod 4 may extend into the adjustable spine rod 5. Alternatively, the adjustable spine rod 5 may extend into the flexible spine rod 4. Predrilled holes may align a portion of the length of both the flexible spine rod 4 and the adjustable spine rod 5. A pin may be placed through the predrilled holes to hold the swim fin 100 at a desired length. Another example mechanism may comprise a twist lock of a standard telescopic pole. Possible materials for the adjustable spine rod 5 may comprise metal, plastic, fiberglass, rubber, or any other material suitable for withstanding diving and propulsion stress. The length of the flexible spine rod 4 and adjustable spine rod 5 may be set to accommodate the desired motion of the attached human. For example, movement at the ankles may cause less resistance through the water. However, movement involving the ankles and knees may prevent calf cramps.

The embodiment of FIG. 1 also comprises a transition rod 6 connected with an end of the adjustable rod 5 opposite the spine rod 4. In some embodiments, the transition rod 6 extends away from the end of the adjustable rod 5 as a first straight rod for a length, then forms a first arcuate bend, then forms a second arcuate bend in the opposite direction, and continues as a second straight rod. In this manner, the first and second straight rods of the transition rod 6 may be substantially parallel. The transition rod 6 may be formed of any material capable of withstanding the thrust of underwater propulsion as well as the strain of use of the swim fin 100. The material of the transition rod 6 may further transfer thrust from the tailfin 1 to the attached human. Possible materials for the transition rod 6 may comprise metal, plastic, fiberglass, rubber, or any other material suitable for withstanding diving and propulsion stress. The transition rod 6 may be formed such that the adjustable rod 5 extends substantially parallel with the attached human's shins. The transition rod 6 may comprise a bend such that the transition rod extends away from the attached human's legs and then substantial parallel with the attached human's back. In this manner, the attached human may assume a form of seated position for use of the swim fin 100. The connection between the transition rod 6 and the adjustable rod 5 may comprised a weld, the transition rod 6 frictionally fit within the adjustable rod 5, or the adjustable rod 5 frictionally fit within the transition rod 6. Alternatively, the transition rod 6 and the adjustable rod 5 may be integrally formed.

The embodiment of FIG. 1 may also comprise a T-shaped plate 7. The T-shaped plate may comprise a base section 15 and a transverse section 14. The base section 15 of the T-shaped plate 7 may be connected to the transition rod 6 opposite the adjustable rod 5. The base section 15 of the T-shaped plate 7 may extend away from the transition rod 6 and may be connected with, or integrally form, the transverse section 14 of the T-shaped plate 7. The transverse section 14 of the T-shaped plate 7 may, for example, be designed to fall at the lower back of the attached human. The T-shaped plate 7 may comprise metal, plastic, rubber, or any other material suitable for frictional attachment to the attached human. The material of the T-shaped plate 7 may also be sufficiently rigid such that the thrust from the tailfin 1 is transferred to the attached human. The attachment between the T-shaped plate 7 and the transition rod 6 may be integrally formed or one may be inserted and frictionally fit within the other.

The embodiment of FIG. 1 may comprise a belt 8 for front attachment extending from both sides of the transverse section 14 of the T-shaped plate 7. The belt 8 may comprise any material sufficient to wrap around and frictionally fit a portion of the torso of the attached human such that thrust from the tailfin 1 is transferred to the attached human. The belt 8 may also withstand exposure to water or salt water. Such materials may comprise woven fabric, rubber, plastic, foam, and similar materials. The attachment of the T-shaped plate 7 and the belt 8 may occur through integral formation. Alternatively, the belt 8 may pass through the length of the transverse section 14 of the T-shaped plate 7, wherein the T-shaped plate 7 is clamped and formed around the belt 8. Alternatively, the belt 8 may only be attached at each end of the transverse section 14 of the T-shaped plate 7.

A belt buckle 9 may be formed at either end or both ends of the belt 8 opposite the T-shaped plate 7. The belt buckle 9 may comprise any structure capable of holding the belt 8 in frictional fit communication with the attached human being. In one embodiment, a male end may be lockably inserted into the female end. Alternative structures may include frame-style belt buckles, plate style buckles, box-out buckles, box-frame buckles, snap-in buckles, Velcro attachments, and similar structures.

Figure 2:
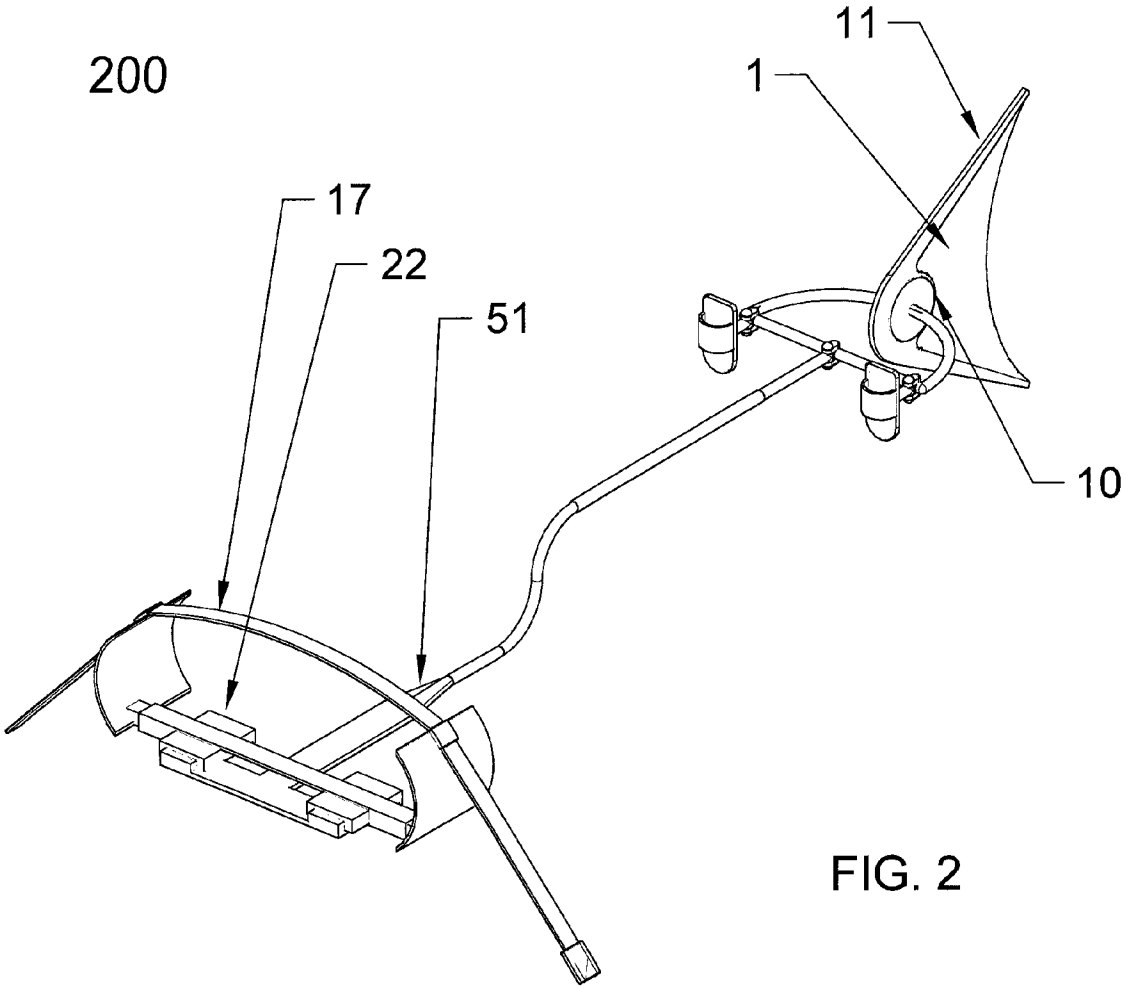
FIG. 2 illustrates another embodiment of a swim fin showing a front mounted, separate belt.

A swim fin 200 in accordance with the embodiment of FIG. 2 may allow positioning of a T-shaped plate 51 in front of the attached human. This embodiment may further allow frictional fit of a belt 17 around the waist of the human before attachment to the T-shaped plate 51. In the embodiment of FIG. 2, the tailfin 1 can also include a reinforcing spine 11. The reinforcing spine 11 may enhance rigidity or spring in the tailfin 1. In turn, the reinforcing spine 11 may increase water displacement of the tailfin 1 and therefore increase forward thrust on the swim fin 200. The reinforcing spine may comprise a thicker formation of the same material as the tailfin 1. The reinforcing spine 11 may alternatively comprise any other material sufficient to reinforce the tailfin 1 and provide spring and rigidity. The spring-back action of the tailfin 1 with reinforcing spine 11 may provide greater strength to the tailfin 1 and cause the tailfin 1 to quickly return to its original shape, thereby providing quick reaction with great thrust. Examples include metals, such as springs, plastics, rubber, fiberglass, carbon fiber, polyurethane, foams, high density foams, bone, sinew, bamboo, and similar materials. The reinforcing spine 11 may be attached to or integrally formed with the tailfin 1. The tailfin 1 and the reinforcing spine 11 may be flexible and lightweight to promote agility of the swim fin 200 and to more closely approximate the movement of a fish. The overall shape of the tailfin 1 may be triangular such that the tailfin 1 resembles that of a fish. The tailfin 1 may be connected with the swim fin 200 at an apex of the tailfin 1. The shape or design of the tailfin 1 may be altered for artistic purposes. Additionally, the material, size, shape, and thickness of the tailfin 1 in conjunction with the material, shape, and thickness of the reinforcing spine 11 may be selected to interact such that a desired acceleration, thrust, top speed, and maneuverability may be achieved. For example, rigidly thicker rigidly flexible materials in a smaller tailfin may provide more acceleration, while larger and more flexible tailfins may provide lower acceleration and higher top speed. Finally, the thickness of the reinforcing spine 11 may be tapered from the apex to the end of the tailfin 1 to alter thrust.

The embodiment of FIG. 2 can also comprise a compression pad 10. The compression pad 10 may comprise an annulus that may be formed around the attachment of the arcuate rod of the swivel motion thruster 2 and the tailfin 1. The compression pad 10 may comprise any structure and material sufficient to absorb pressure to reduce damage to the tailfin 1 resulting from movement of the swivel motion thruster 2 during use. Dispersion of force from the swivel motion thruster 2 may reduce the likelihood of tearing the tailfin 1. Sufficient pressure absorbing materials may include metals, plastics, rubber, fiberglass, carbon fiber, polyurethane, foams, high density foams, bone, sinew, bamboo, and similar materials. The material of the compression pad 10 may also be resilient after exposure to water or salt water.

The embodiment of FIG. 2 can comprise an T-shaped plate 51. The T-shaped plate 51 may be comprised of rigid materials. These materials may be sufficiently rigid such that thrust from the tailfin 1 is transferred to the attached human. Example materials include rubber, plastic, metal, wood, fiberglass, carbon fiber, bone, bamboo, high density foam, polyurethane, and similar materials. The T-shaped plate 51 may be similar in structure to the T-shaped plate 7. However, the T-shaped plate 51 may removably attach to the belt 17. The embodiment of FIG. 2 also illustrates a base section 56 of the T-shaped plate 51 and a transverse section 58 of the T-shaped plate 51.

Figure 3:
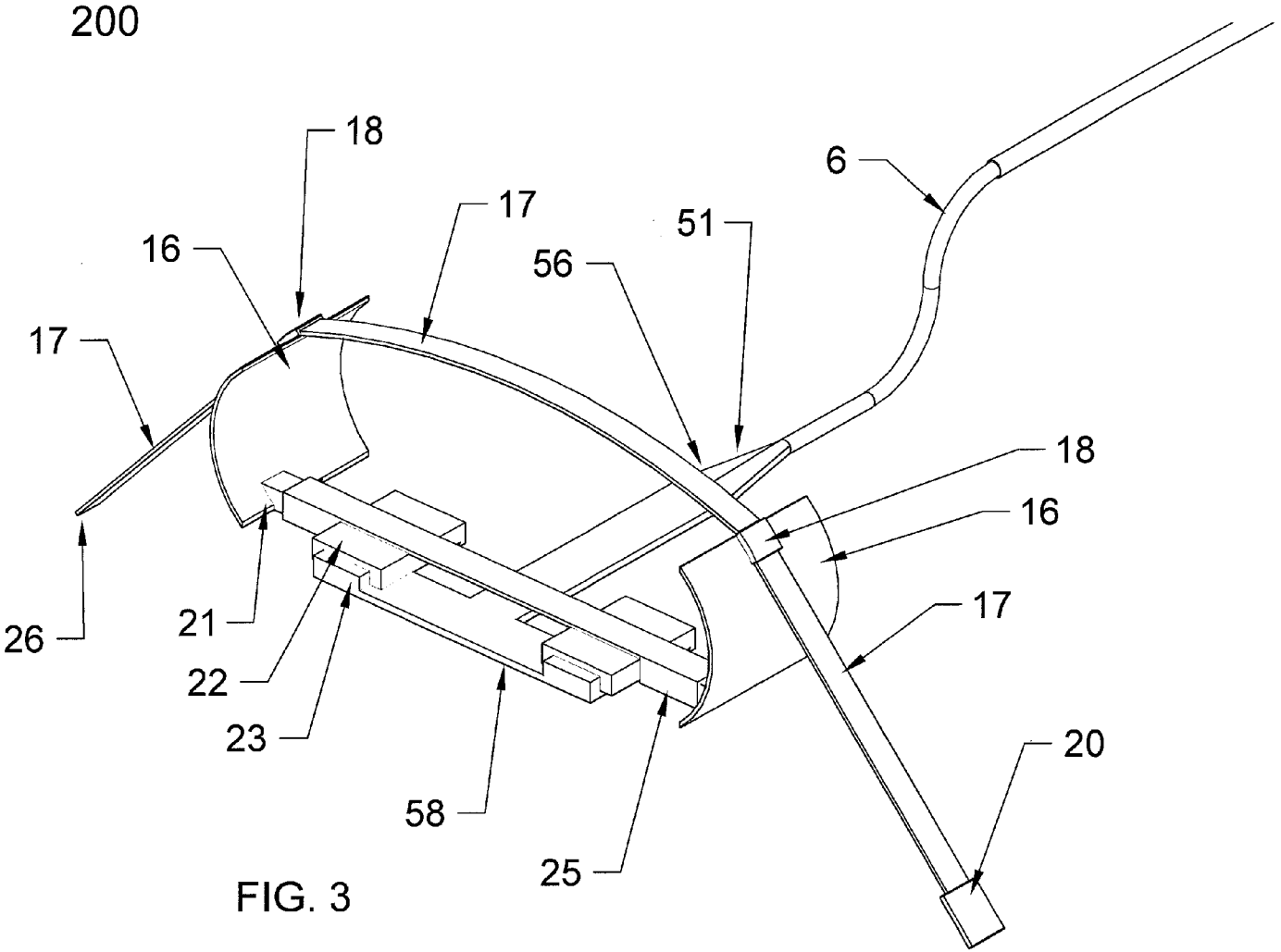
FIG. 3 illustrates an enlarged partial pictorial of a separate belt variation of the swim fin of FIG. 2.

FIG. 3 illustrates an enlarged depiction of a portion of a separate belt variation of the swim fin 200 of FIG. 2. In some embodiments, the transition rod 6 may be rotated such that the T-shaped plate 51 may be positioned in front of the attached human. In the illustrated embodiment, this positioning of the T-shaped plate 51 may allow for the attached human to releasably engage or disengage the belt 17 from the T-shaped plate 51. The T-shaped plate 51 may comprise male slats 23. These male slats 23 may be fixed to or integrally formed with the T-shaped plate 51. Receptors 22 may be configured to receive and releasably engage the male slats 23. The receptors 22 may be connected to or integrally formed with an extension arm 25. The extension arm 25 may comprise a rod 54 that connects the receptors 22 and may extend beyond the transverse section of the T-shaped plate 51. The extension arm 25 may be configured such that an adjustment arm 21 may be moved relative to the extension arm 25 to alter the length of the extension arm 25 and therefore the size of an opening encircled in part by the belt 17. In some embodiments, a second adjustment arm 21 may be positioned at the end of the extension arm 25 opposite a first adjustment arm 21. In some embodiments, one or both adjustment arms 21 may be connected with a respective hip pad 16. The hip pad 16 may be comprised of any material to aid in human comfort while frictionally fitting the belt 17 to the attached human. The hip pad 16 may also be water resistant. Example materials include metals, plastics, rubber, fiberglass, carbon fiber, polyurethane, foams, high density foams, bone, sinew, bamboo, and similar materials. The hip pads 16 may comprise a belt loop 18 on an outer surface of the hip pads 16. The belt loop 18 may comprise an integrally formed loop of the same material as the hip pad 16. Alternatively, the belt loop 18 may comprise any material attached to the outer surface of the hip pad 16. The material and manner of attachment of the belt loop 18 may be sufficient to hold the belt 17 in place during use of the swim fin 200. In this embodiment, a respective buckle 20 may be positioned at one or both of the belt ends 26. Furthermore, the hip pads 16 and the buckle 20 may be used to control the waist size to maintain frictional fit with the attached human.

Figure 4:
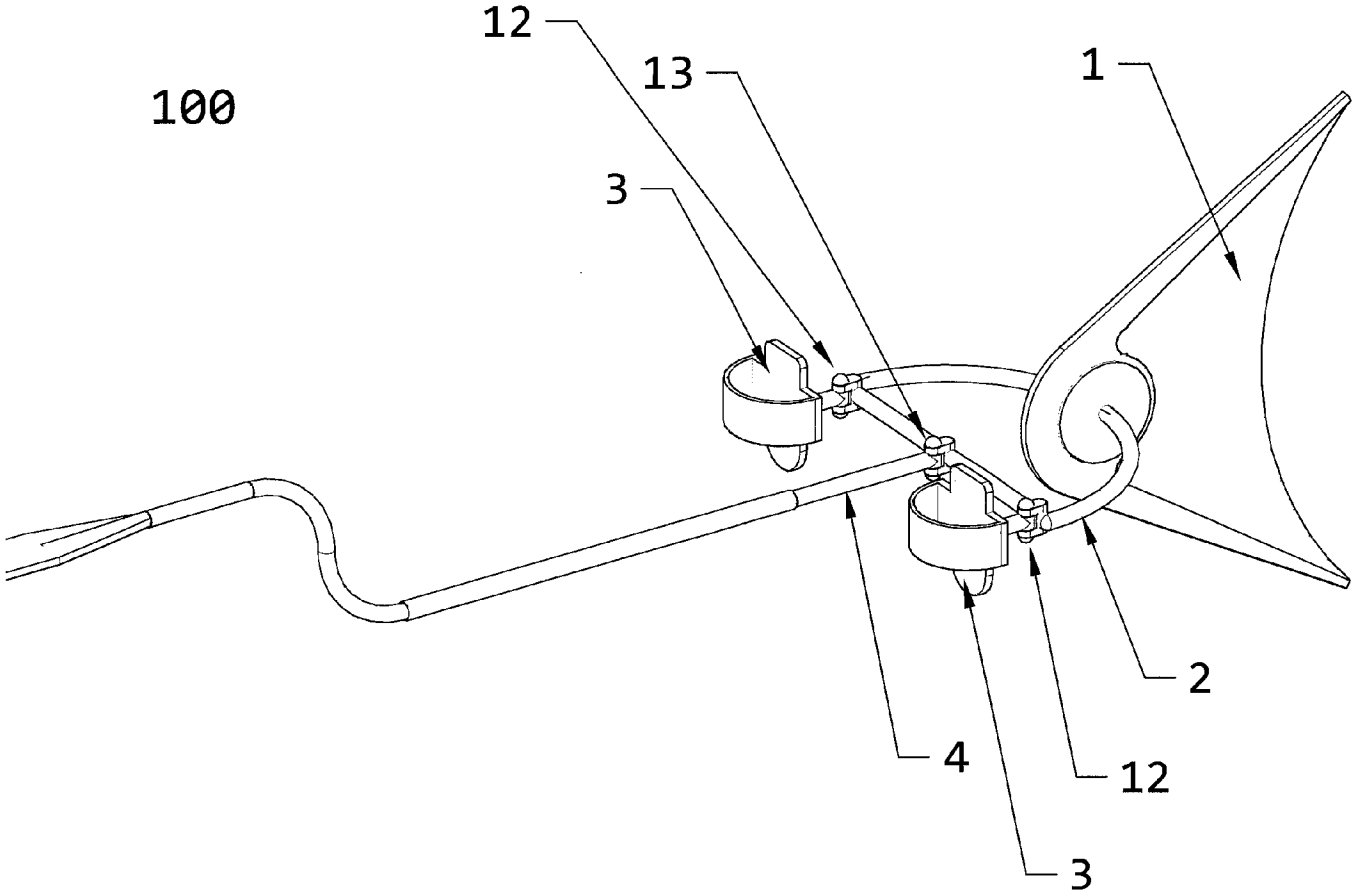
FIG. 4 illustrates an enlarged partial pictorial of a tailfin 1 of the swim fin of FIG. 1.

FIG. 4 illustrates an enlarged view of the tailfin 1 of the swim fin 100 of FIG. 1. In this embodiment, the foot pockets 3 may be alternatingly pushed and pulled to generate thrust from the tailfin 1. The hinged interaction between the flexible spine rod 4, the swivel hinge 13, the foot pockets 3, the pedal hinges 12, and the swivel motion thruster 2 may cause the tailfin 1 to move in an arcuate sweep in a horizontal plane of the swivel motion thruster 2.

Figure 5:
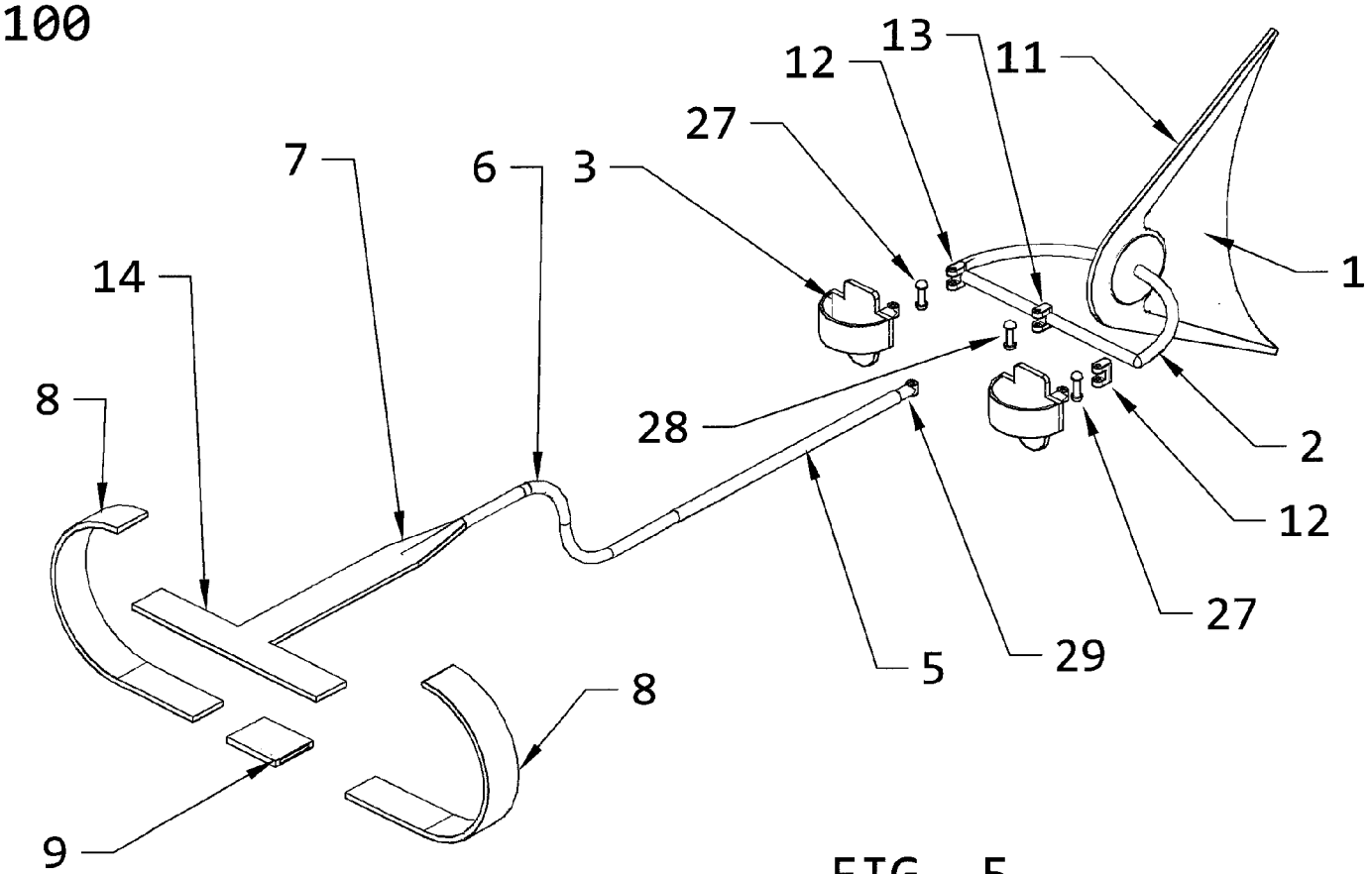
FIG. 5 illustrates an exploded view of the swim fin of FIG. 1.

FIG. 5 illustrates an exploded view of the swim fin 100 of FIG. 1. This figure further illustrates the swivel mechanism (e.g. components 2, 13, 28, and 29) of the swim fin 100. The pedal hinges 12 may comprise outer swivel connector pins 27. The outer swivel connector pins 27 may comprise any material sufficient to withstand the force generated by the attached human 100 and the friction from motion of the pedal hinge 12. The outer swivel connector pin 27 may also be resistant to rust or corrosion. Example rust resistant materials include coated metals, stainless steel, durable plastics, rubber, and similar materials. The swivel hinge 13 may comprise a swivel connector pin 28. The swivel connector pin 28 may withstand the force generated by thrust of the swim fin 100 as well as friction of operation of the swivel hinge 13. The swivel connector pin 28 may be resistant to rust or corrosion. Example rust resistant materials include coated metals, stainless steel, durable plastics, rubber, and similar materials. The swivel hinge 13 may also comprise a swivel connector 29, wherein the swivel connector 29 may be attached to the end of the flexible spine rod 4 or the adjustable spine rod 5. The swivel connector 29 may fit within the swivel hinge 13, wherein a through hole in the swivel hinge 13 and the swivel connector 29 may be aligned. The swivel connector pin 28 may be inserted through the through holes of the swivel hinge 13 and the swivel connector 29.

Figure 6B:
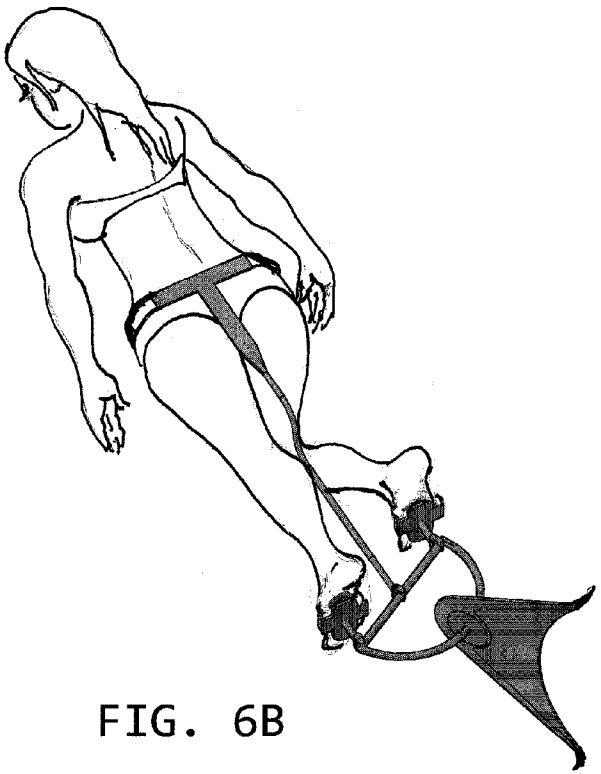
FIG. 6B illustrates the engagement of the swim fin with a human body.
Figure 6A:
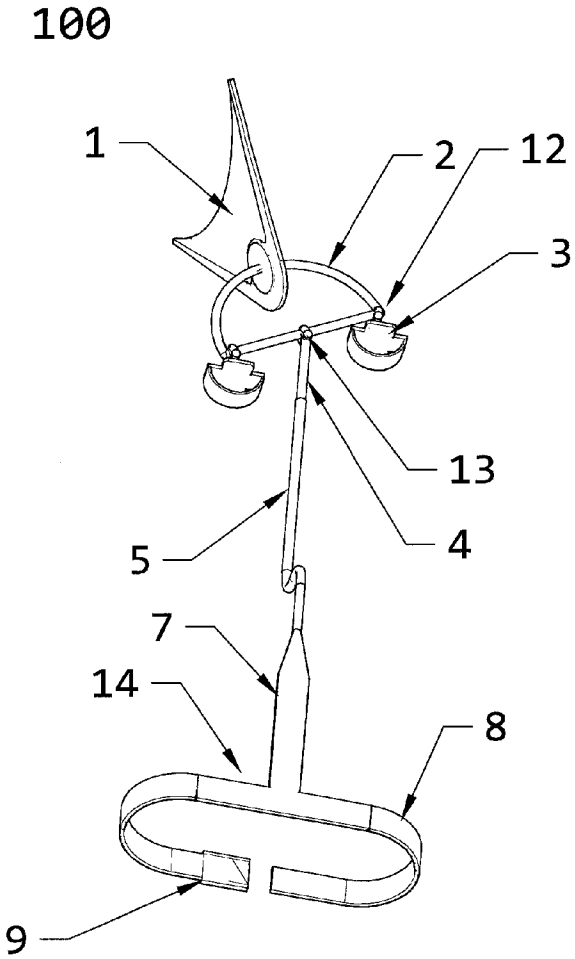
FIG. 6A illustrates the swim fin of FIG. 1 in a flexed position.

FIG. 6A illustrates the swim fin 100 of FIG. 1 in a flexed position and FIG. 6B depicts engagement of the swim fin 100 with a human. As illustrated in FIG. 6*b*, the planes of the pedals 3*b* may remain parallel even when the swim fin 100 is flexed. This may allow the attached human to propel the swim fin 100 using a natural range of motion. Also illustrated in FIG. 6B, the T-shaped plate 7 of the swim fin 100 may be frictionally fit to the back of the attached human.

Figure 7:
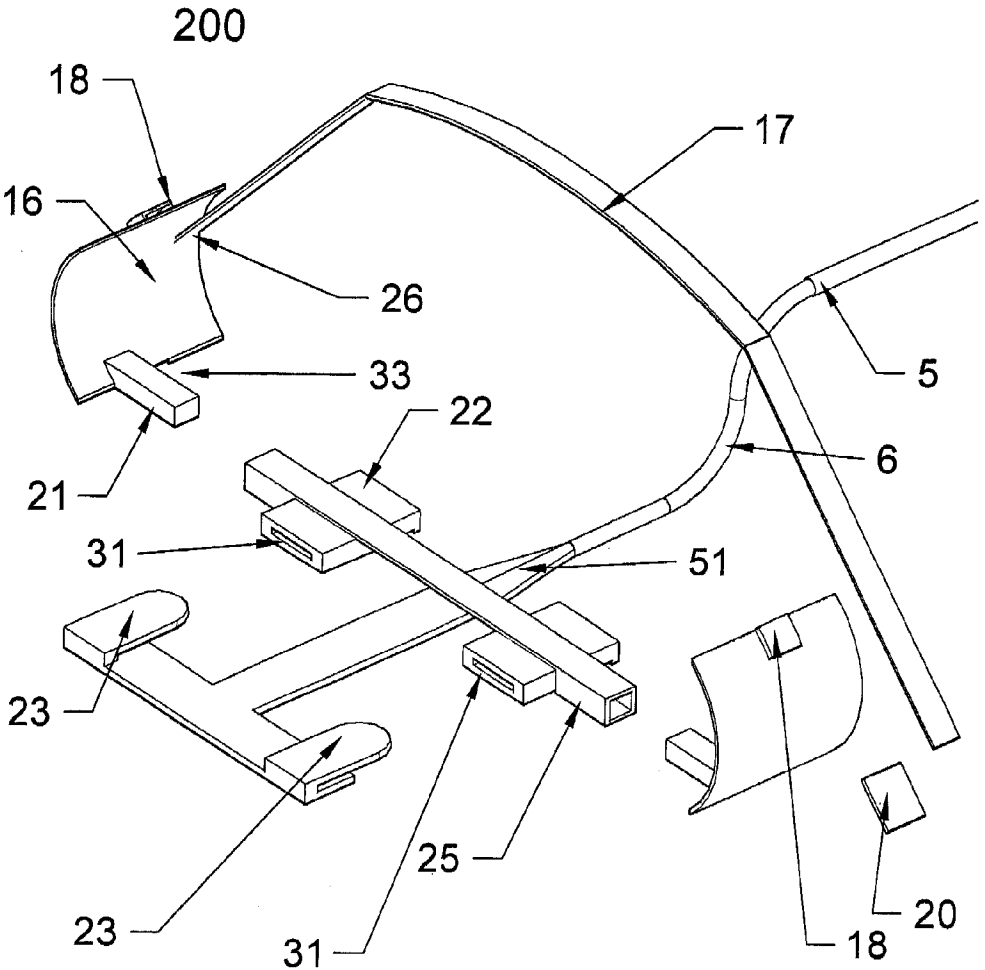
FIG. 7 illustrates an exploded view of the belt of the swim fin of FIG. 2.

FIG. 7 illustrates an exploded view of a belt section of the swim fin 200 of FIG. 2. The configuration for releasable engagement between the male slats 23 and the receptors 22 is shown. In this embodiment, the receptors 22 may comprise slots 31 configured to allow insertion of the male slats 23. The receptors 22 may allow the belt 17 to be frictionally fit to the human and subsequent attachment of the swim fin 200 once the human is in water.

Figure 8:
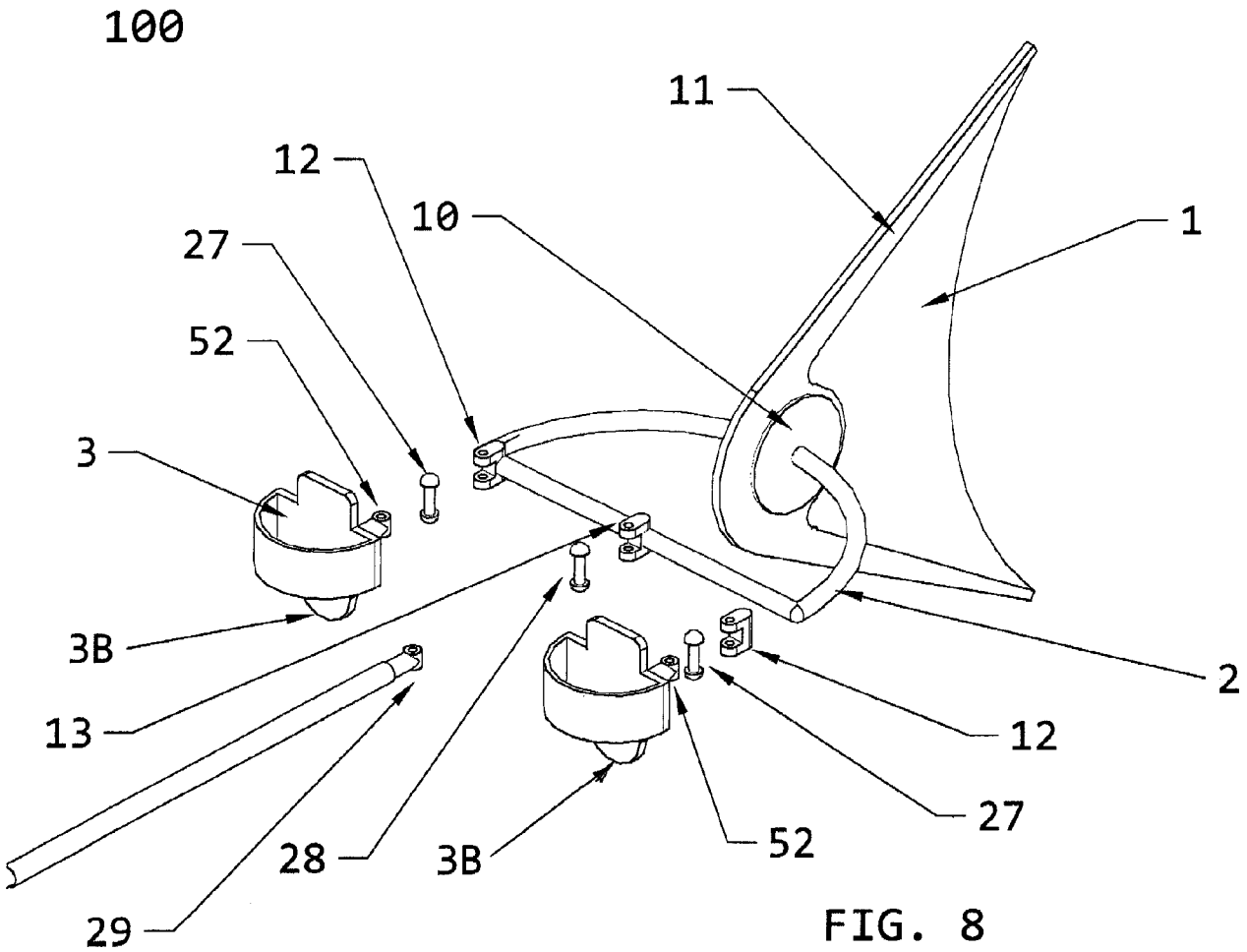
FIG. 8 illustrates a zoomed exploded view of the tailfin 1 of the swim fin of FIG. 1.

FIG. 8 illustrates a zoomed exploded view of the tailfin 1 of the swim fin 100 of FIG. 1. The tailfin 1 of FIG. 8 may further comprise a respective pedal swivel connector 52 on the bottom of each of the pedals 3*b*. The pedal swivel connector 52 may be placed within one of the outer swivel hinges 12 such that a through hole of each pedal swivel connector 52 and a through hole of one of the outer swivel hinges 12 align. An outer swivel connector pin 27 may be inserted through each respective set of aligned through holes.

Figure 10:
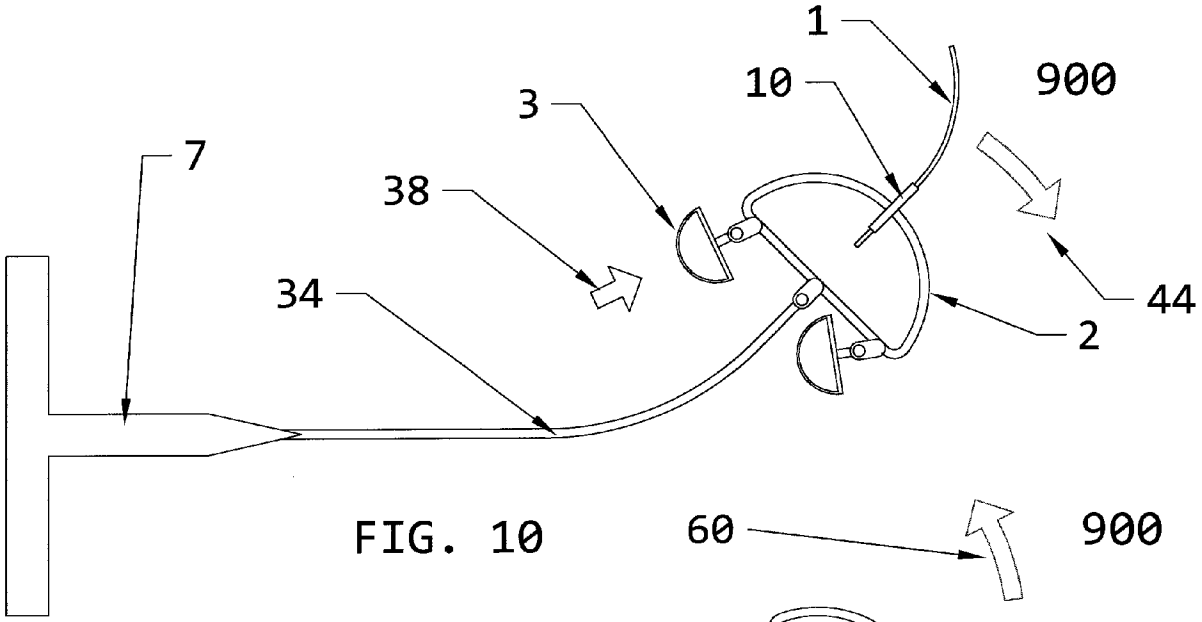
FIGS. 9 and 10 illustrate an embodiment of a swim fin wherein a flexible spine rod connects a swivel hinge and a T-shaped plate.
Figure 9:
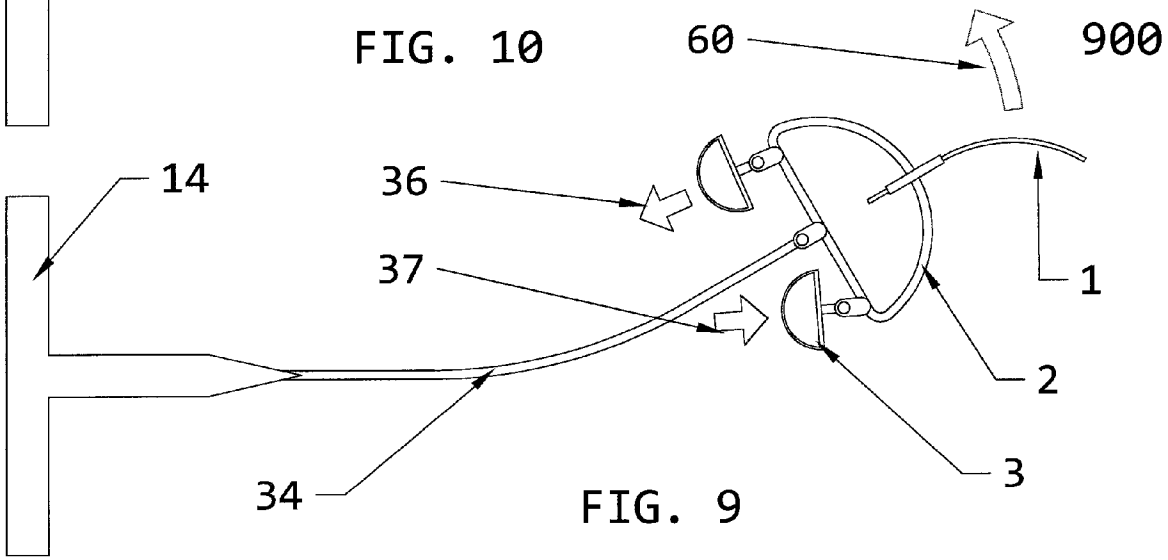

FIGS. 9 and 10 illustrate an embodiment of a swim fin 900 wherein a different flexible spine rod 34 connects the swivel hinge 13 and the T-shaped plate 7. This flexible spine rod 34 may comprise any material sufficient to allow bending and straightening to the original position. Rigidly flexible materials may aid in quick acceleration underwater due to the snap-return to the original position of the spine rod 34. Flexible materials may aid in a longer arcuate motion of the tailfin 1, which may allow in propulsion using less effort and less oxygen. Suitable materials may comprise metals, plastics, rubber, fiberglass, carbon fiber, polyurethane, foams, high density foams, bone, sinew, bamboo, and similar materials.

Figure 12:
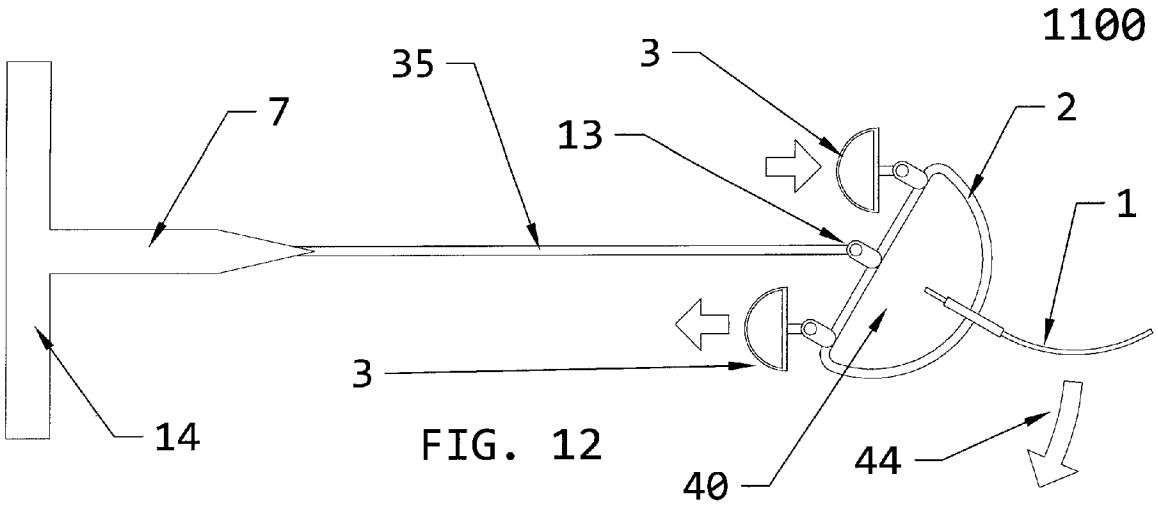
FIG. 12 illustrates the swim fin of FIG. 11 wherein pressure is applied to cause an arcuate sweeping motion of the tailfin.
Figure 11:
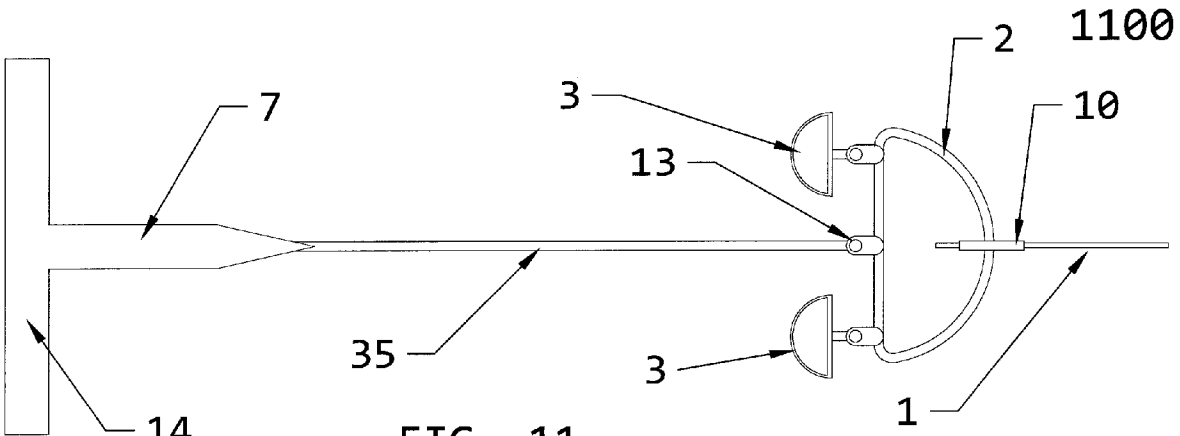
FIG. 11 illustrates an embodiment of a swim fin wherein a rigid spine rod connects the swivel hinge and the T-shaped plate.

FIG. 11 illustrates an embodiment of a swim fin 1100 comprising a rigid spine rod 35. The rigid spine rod 35 may be connected with the T-shaped plate 7 as well as the swivel hinge 13. FIG. 12 illustrates the swim fin 1100 of FIG. 11 wherein pressure is applied to cause an arcuate sweeping motion in a first direction 44 of the tailfin 1. In this embodiment, the arcuate sweeping motion is not extended by a flexing of the rigid spine rod 35.

Figure 13:
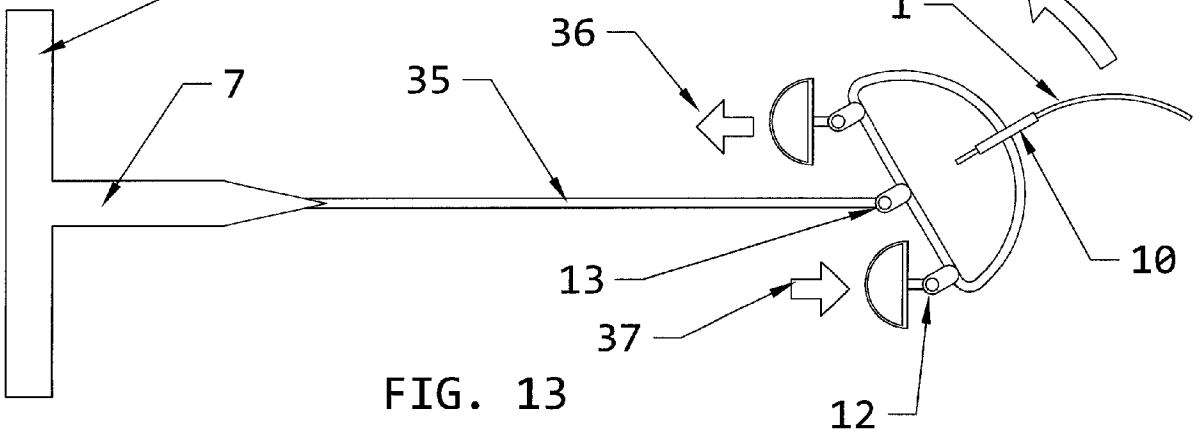
FIG. 13 illustrates an embodiment of a swim fin of FIG. 11 wherein pressure is applied to cause an arcuate sweeping motion of the tailfin.

FIG. 13 illustrates the swim fin of FIG. 11 wherein pressure is applied to cause an arcuate sweeping motion of the tailfin 1 in an opposite direction 45 as that of the direction 44 of the tailfin 1 of FIG. 12.

Figure 14:
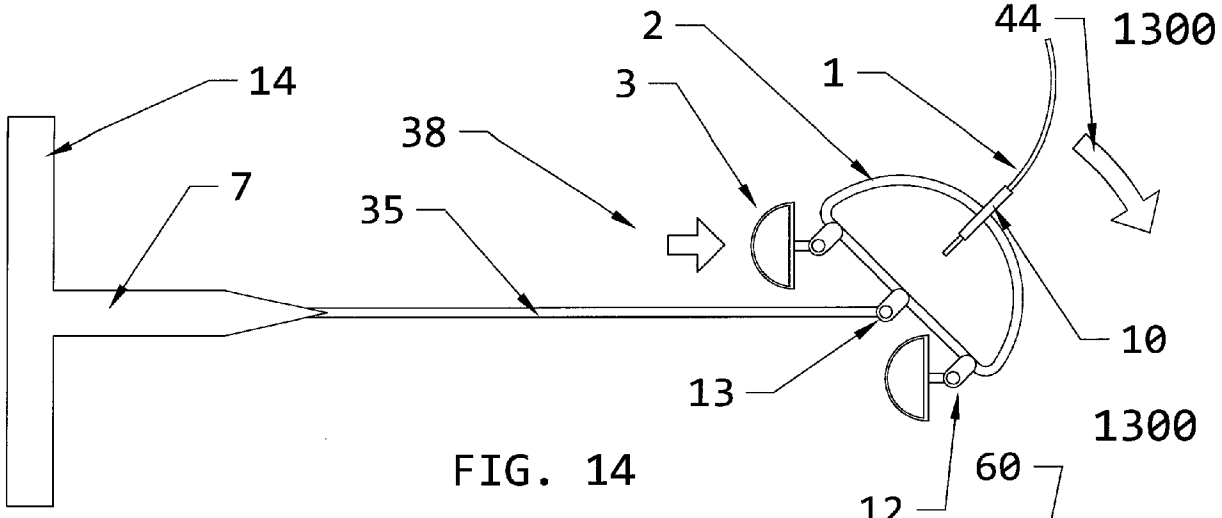
FIG. 14 illustrates the swim fin of FIG. 13 wherein the tailfin 1 has reached maximum flexion and pressure is applied to reverse direction of the arcuate sweep of the tailfin.

FIG. 14 illustrates the swim fin of FIG. 11 wherein the tailfin 1 has reached maximum flexion and pressure is applied to reverse direction of the arcuate sweep of the tailfin 1.

Figure 16:
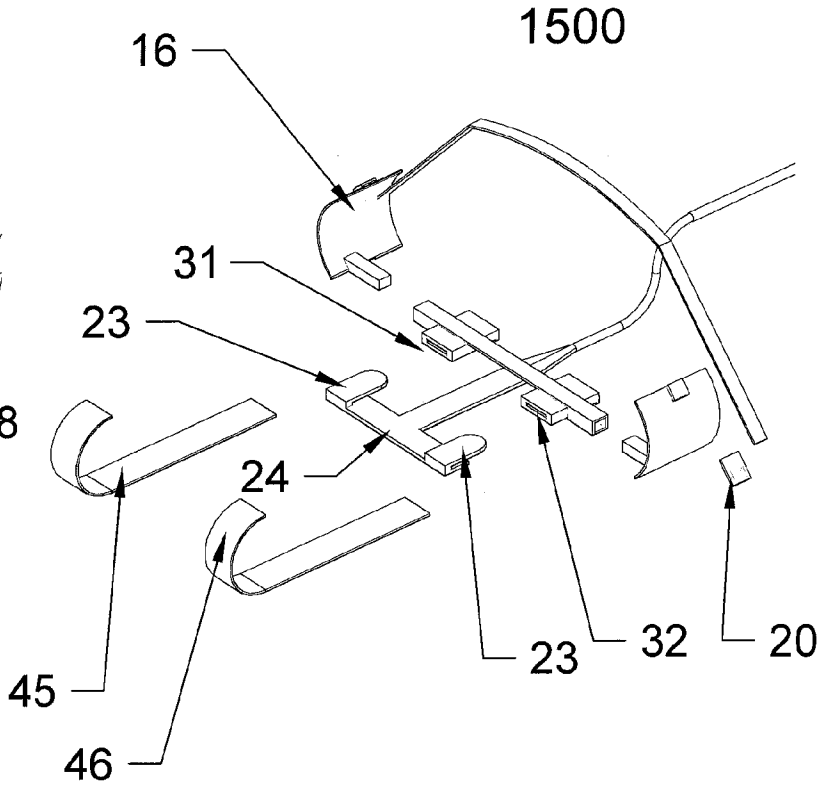
FIG. 16 illustrates an exploded view of the swim fin with detachable shoulder straps of FIG. 15.
Figure 15:
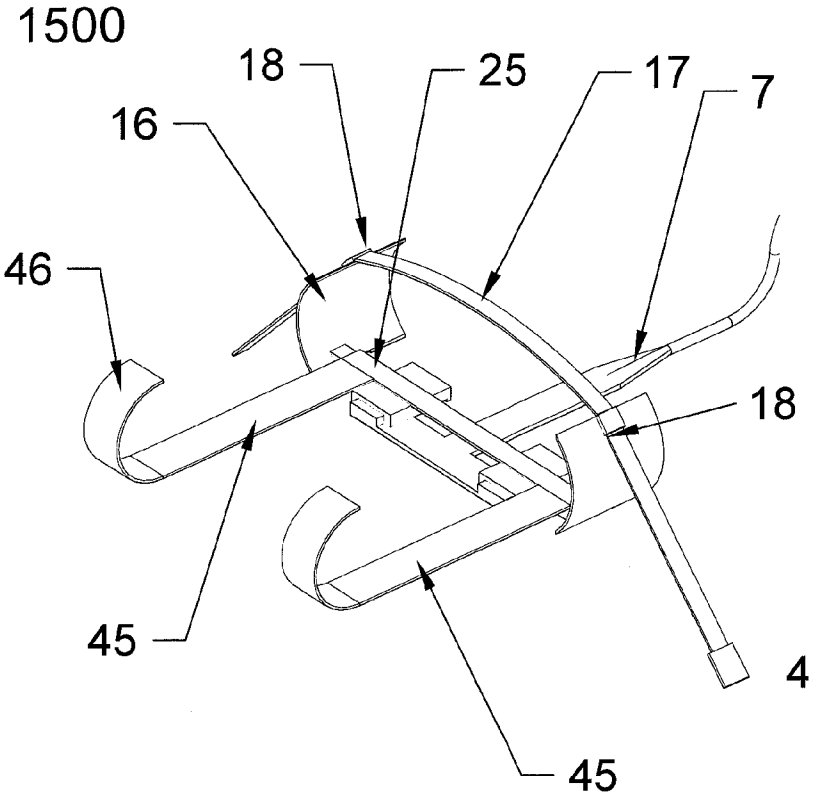
FIG. 15 illustrates an embodiment of a swim fin of FIG. 2 comprising detachable shoulder straps.

FIG. 15 illustrates one embodiment of the swim fin 200 of FIG. 2 that can also include shoulder straps 45. The shoulder straps 45 may comprise shoulder hooks 46. The shoulder hooks 46 may fit around the shoulders of the attached human. The shoulder straps 45 may be detachably attached to or integrally formed with the extension arm 25. The shoulder straps 45 may comprise any material or structure sufficient to frictionally fit the shoulder straps 45 to the attached human. FIG. 16 illustrates an exploded view of the detachable shoulder straps 45 of FIG. 15.

Figure 17:
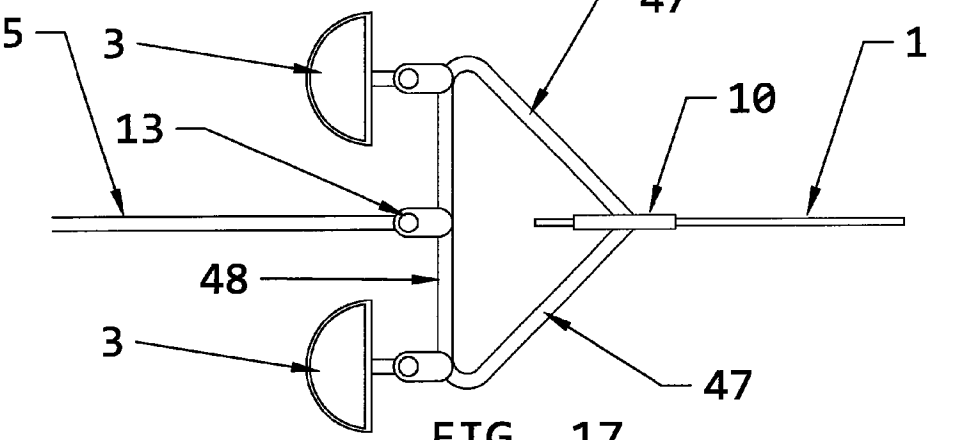

FIG. 17 illustrates details of a triangular shaped swivel motion thruster comprising two arms 47. The triangular shaped swivel motion thruster may also comprise a motion thruster connector 48, wherein the motion thruster connector 48 may be a perpendicular bar hingeably connected to the adjustable spine rod 5 by the swivel hinge 13. The motion thruster connector 48 may connect outside ends of the two arms 47 of the triangular shaped swivel motion thruster.

Figure 18:
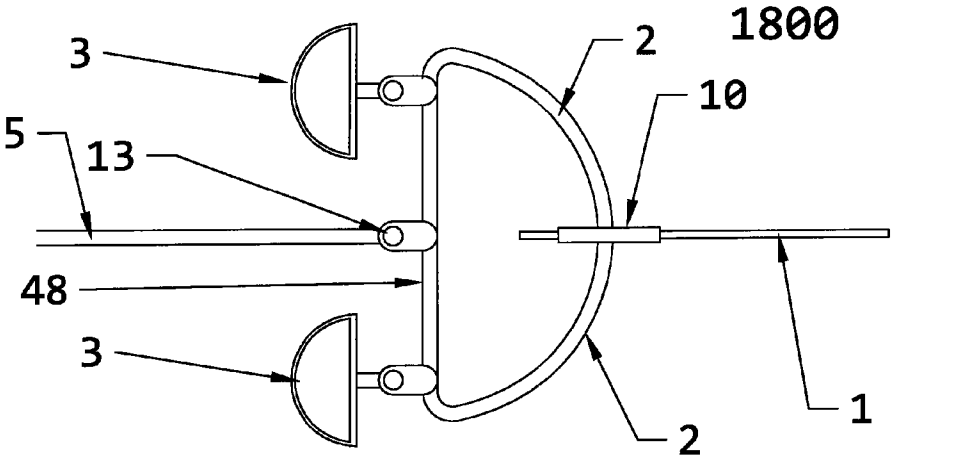
FIGS. 17-19 depict different embodiments of how foot pockets can be coupled with a tailfin in conjunction with one or more embodiments of swimfins described herein.

FIG. 18 illustrates details of an arcuate swivel motion thruster 2 similar to ones shown in FIG. 1 and FIG. 2.

Figure 19:
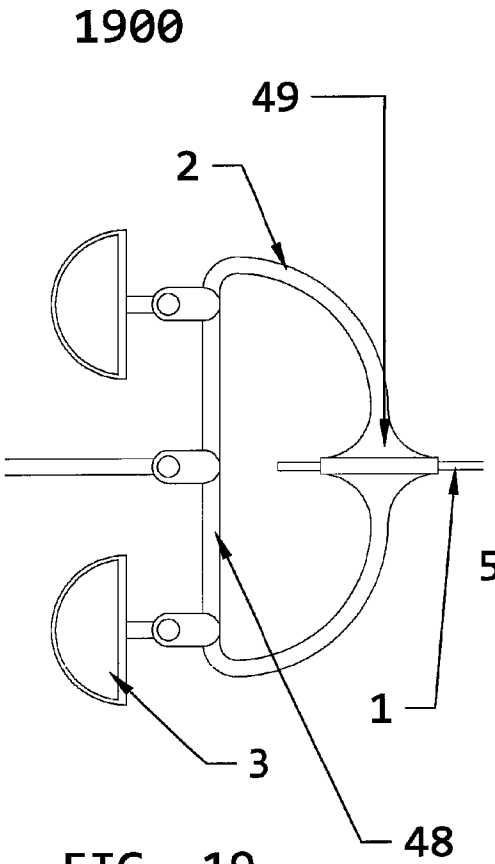

FIG. 19 illustrates details of a swim fin comprising a compression pad 10 having a spread footing 49. This embodiment of the compression pad 10 disperses force applied to the tailfin 1 from the swivel motion thruster 2. This may reduce the likelihood of damage to the tailfin 1.

Figure 20:
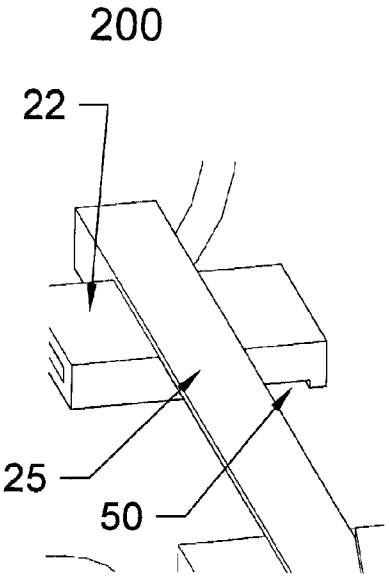
FIG. 20 illustrates a zoomed view of the swim fin of FIG. 2 wherein a receptor comprises a belt restraining groove.

FIG. 20 illustrates a zoomed view of a portion of the swim fin 200 of FIG. 2 wherein the receptor 22 comprises a belt restraining groove 50. The belt 17 restraining groove 50 may comprise a recess in the receptor 22 in which the belt 17 may lie. The restraining groove 50 may be of sufficient shape and depth to hold the belt 17 within the restraining groove 50 when the belt 17 is frictionally fit around the attached human.

Embodiments of the swim fin are capable of being used in the water. Thus, various components of the swim fin can be selected based on reducing overall weight and increasing overall strength of the swim fin.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and "comprising," when used in this specification, specify the presence of stated features, steps, operations, elements, and/or components, but do not preclude the presence or addition of one or more other features, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. Aspects of the invention were chosen and described in order to best explain the principles of the invention and the practical application, and to enable others of ordinary skill in the art to understand the invention for various embodiments with various modifications as are suited to the particular use contemplated.

What is claimed is:

1. A swim fin, comprising:

a swivel motion thruster;

a tailfin coupled with the swivel motion thruster;

a spine rod hingeably coupled via a first hinged coupling with the swivel motion thruster at a first end of the spine rod;

a first foot pocket coupled with the swivel motion thruster on one side of the first hinged coupling and a second foot pocket coupled with the swivel motion thruster on an opposite side of the first hinged coupling such that movement of the first foot pocket toward the tailfin results in an arcuate motion of the tailfin about the first hinged coupling away from the first foot pocket, wherein each of the first foot pocket and the second foot pocket is configured to receive a respective human foot; and a belt coupled with a second end of the spine rod opposite the first end, wherein the belt is configured to frictionally fit to a human body;

wherein the swivel motion thruster comprises:

an arcuate rod having a third end and a fourth end; and a motion thruster connector connected with the arcuate rod; and wherein the motion thruster connector comprises a straight rod having a fifth end and a sixth end, wherein the third end of the arcuate rod is connected with the fifth end and the fourth end of the arcuate rod is connected with the sixth end.

2. The swim fin of claim 1, wherein the first foot pocket comprises a first pedal and the second foot pocket comprises a second pedal.

3. The swim fin of claim 1, wherein the first foot pocket comprises a first pedal and a first strap; and the second foot pocket comprises a second pedal and a second strap.

4. A swim fin comprising:

a swivel motion thruster;

a tailfin coupled with the swivel motion thruster;

a spine rod hingeably coupled via a first hinged coupling with the swivel motion thruster at a first end of the spine rod;

a first foot pocket coupled with the swivel motion thruster on one side of the first hinged coupling and a second foot pocket coupled with the swivel motion thruster on an opposite side of the first hinged coupling such that movement of the first foot pocket toward the tailfin results in an arcuate motion of the tailfin about the first hinged coupling away from the first foot pocket, wherein each of the first foot pocket and the second foot pocket is configured to receive a respective human foot; and a belt coupled with a second end of the spine rod opposite the first end, wherein the belt is configured to frictionally fit to a human body;

wherein the first foot pocket is hingeably connected via a second hinged coupling with the swivel motion thruster; and wherein the second foot pocket is hingeably connected via a third hinged coupling with the swivel motion thruster.

5. The swim fin of claim 1, wherein the spine rod is hingeably coupled via a second hinged coupling with a center of the motion thruster connector of the swivel motion thruster.

6. The swim fin of claim 1, wherein the spine rod further comprises a flexible spine rod.

7. The swim fin of claim 6, wherein the flexible spine rod comprises a material biased to return to a straight position from a flexed position.

8. The swim fin of claim 1, wherein the spine rod further comprises an adjustable spine rod, and wherein the adjustable spine rod is configured to expand or contract an overall length of the swim fin.

9. The swim fin of claim 1, comprising:

a T-shaped plate, wherein a transverse section of the T-shaped plate is coupled with the belt and a base section of the T-shaped plate is coupled with the spine rod.

10. The swim fin of claim 9, wherein a transition rod coupled between the T-shaped plate and the spine rod, wherein the transition rod comprises at least one bend such that a first longitudinal axis of the T-shaped plate is offset from a second longitudinal axis of the spine rod.

11. The swim fin of claim 1, wherein the tailfin comprises flexible material.

12. The swim fin of claim 1, wherein the tailfin further comprises a reinforcing spine.

13. The swim fin of claim 1, wherein the tailfin further comprises a compression pad configured to distribute force from the swivel motion thruster over a portion of a surface area of the tailfin.

14. The swim fin of claim 9, wherein the belt further comprises an extension arm coupled with a receptor.

15. The swim fin of claim 14, wherein the T-shaped plate further comprises at least one male slat configured to detachably engage the receptor of the belt.

16. The swim fin of claim 1, wherein the belt further comprises an extension arm comprising an adjustment arm;

wherein the adjustment arm is configured to alter a length of the extension arm.

17. The swim fin of claim 1, further comprising a shoulder strap coupled with the swim fin configured to frictionally fit the human body.

18. The swim fin of claim 17, wherein the belt comprises an extension arm and the shoulder strap extends from the belt in a direction away from the tailfin.

19. A swimming aid, comprising:

a belt configured to frictionally fit a human body;

a spine rod having a first end and a second end, wherein the first end is coupled with the belt and the spine rod extends away from the belt to the second end;

a swivel hinge having a first portion connected to the second end of the spine rod;

a straight rod having third end and a fourth end, wherein the swivel hinge has a second portion connected to the straight rod at a position substantially equidistant from the third end and fourth end;

a first pedal hinge connected at the third end;

a second pedal hinge connected at the fourth end;

a first foot pocket connected to the first pedal hinge;

a second foot pocket connected to the second pedal hinge;

an arcuate rod, having a fifth end and a sixth end, wherein the fifth end is connected to the third end of the straight rod and the sixth end is connected to the fourth end of the straight rod;

a tailfin connected at an apex of the arcuate rod wherein a plane of the tailfin is substantially perpendicular to a plane of the arcuate rod, wherein the tailfin includes a first edge and a second, opposite, edge in the plane of the tailfin and a distance between the first edge and the second edge increases as the tailfin extends away from the arcuate rod.

* * * * *